US009081343B2

(12) United States Patent
Kamoda et al.

(10) Patent No.: US 9,081,343 B2
(45) Date of Patent: Jul. 14, 2015

(54) IMAGE FORMING APPARATUS CONTROLLING FOR GLOSSINESS

(71) Applicants: Yuji Kamoda, Ibaraki (JP); Junya Hirayama, Takarazuka (JP); Shigeo Uetake, Takatsuki (JP); Toshiya Natsuhara, Takarazuka (JP)

(72) Inventors: Yuji Kamoda, Ibaraki (JP); Junya Hirayama, Takarazuka (JP); Shigeo Uetake, Takatsuki (JP); Toshiya Natsuhara, Takarazuka (JP)

(73) Assignee: KONICA MINOLTA BUSINESS TECHNOLOGIES, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/763,142

(22) Filed: Feb. 8, 2013

(65) Prior Publication Data

US 2013/0209150 A1 Aug. 15, 2013

(30) Foreign Application Priority Data

Feb. 14, 2012 (JP) ..... 2012-029279

(51) Int. Cl.
*G03G 15/20* (2006.01)
*G03G 15/00* (2006.01)

(52) U.S. Cl.
CPC ..... *G03G 15/2089* (2013.01); *G03G 15/206* (2013.01); *G03G 15/2021* (2013.01); *G03G 15/2064* (2013.01); *G03G 15/6585* (2013.01)

(58) Field of Classification Search
CPC ..... G03G 15/2021; G03G 15/206; G03G 15/2064; G03G 15/2089; G03G 15/6585
USPC ..... 399/335, 341; 219/216
See application file for complete search history.

(56) References Cited

U.S. PATENT DOCUMENTS 4,639,405 A * 1/1987 Franke ..... 430/124.13
5,004,891 A * 4/1991 Landis ..... 219/388
5,177,552 A * 1/1993 Isogai et al. ..... 399/330
5,805,969 A * 9/1998 Elsermans et al. ..... 399/341

(Continued)

FOREIGN PATENT DOCUMENTS

JP 2000-221821 A 8/2000
JP 2005-284048 A 10/2005

(Continued)

OTHER PUBLICATIONS

Japanese Office Action (Notice of Grounds of Rejection) dated Jan. 21, 2014, issued in corresponding Japanese Patent Application No. 2012-029279 an an English Translation thereof. (6 pgs).

(Continued)

*Primary Examiner* — Francis Gray
(74) *Attorney, Agent, or Firm* — Buchanan Ingersoll & Rooney PC

(57) ABSTRACT

An image forming apparatus includes a fixing device for heating and pressing a toner image on a recording medium, a non-contact heating device arranged downstream of the fixing device for heating the toner image without coming into contact with the toner image, and a pressure contact device arranged downstream of the non-contact heating device and having a smooth surface. The pressure contact device has first and second arrangement states switched according to the kind of the recording medium. In the first arrangement state, the pressure contact device is arranged so as to make pressure contact with the toner image. In the second arrangement state, the pressure contact device is arranged so as not to make pressure contact with the toner image.

4 Claims, 4 Drawing Sheets

(56) References Cited

U.S. PATENT DOCUMENTS

| | | | | |
|---|---|---|---|---|
| 6,130,408 | A * | 10/2000 | Fukuda et al. | 219/216 |
| 7,890,036 | B2 * | 2/2011 | Kitano et al. | 399/320 |
| 8,180,270 | B2 | 5/2012 | Yasutomi et al. | |
| 2002/0102118 | A1 * | 8/2002 | Kosugi et al. | 399/341 |
| 2006/0024096 | A1 * | 2/2006 | Kimura | 399/325 |
| 2011/0206429 | A1 * | 8/2011 | Terao et al. | 399/341 |

FOREIGN PATENT DOCUMENTS

| | | | |
|---|---|---|---|
| JP | 2006-085063 | A | 3/2006 |
| JP | 2009-008709 | A | 1/2009 |
| JP | 2010-127967 | A | 6/2010 |
| JP | 2010127966 | A | 6/2010 |
| JP | 2011064714 | A | 3/2011 |
| JP | 2011137963 | A * | 7/2011 |

OTHER PUBLICATIONS

Office Action from the Japan Patent Office dated Sep. 30, 2014, issued in corresponding Japanese Patent Application No. 2012-029279, with English translation thereof. (10 pages).

* cited by examiner

IMAGE FORMING APPARATUS CONTROLLING FOR GLOSSINESS

This application is based on Japanese Patent Application No. 2012-029279 filed with the Japan Patent Office on Feb. 14, 2012, the entire content of which is hereby incorporated by reference.

BACKGROUND OF THE INVENTION

1. Field of the Invention

The present invention relates to an image forming apparatus, and more particularly to an image forming apparatus that forms an image on a surface of a recording medium such as print paper using a wet-type electrophotographic technique.

2. Description of the Related Art

Japanese Laid-Open Patent Publication No. 2006-085063 discloses an invention directed to a fixing device which heats a toner image and fixes the toner image on a recording medium. This fixing device includes an infrared ray transmitting member (conveyance belt). The infrared ray transmitting member is disposed on a printed surface side of a recording medium downstream of the fixing device and transmits infrared rays. This publication describes that unevenness of toner surfaces can be reduced by bringing the infrared ray transmitting member into pressure contact with fused toner.

Japanese Laid-Open Patent Publication No. 2005-284048 discloses an invention directed to a fixing device which imparts gloss to a toner image on a recording medium. This fixing device includes image smoothening means for smoothing a surface of a toner image transferred to a recording medium, and image penetrating means configured as a final stage unit of the fixing device for penetrating the toner image having been subjected to the image smoothening means, into the recording medium without coming into contact with the toner image on the recording medium. According to this publication, in the image forming apparatus including the fixing device, a cross-sectional shape of a surface of an image on the recording medium after subjecting to the fixing follows a cross-sectional shape of a surface of the recording medium that image gloss is changed according to gloss of a recording medium, and images having high gloss can be obtained easily.

Japanese Laid-Open Patent Publication No. 2009-008709 discloses an invention directed to an image forming apparatus which forms an image on a variety of recording media with different glossiness levels. The image forming apparatus includes fixing means for fixing a toner image on a recording medium by applying heat to the toner image, and re-heating means for re-heating the toner image, fixed on the recording medium by the fixing means, to set a glossiness level of the toner image lower than a glossiness level before re-heating. According to this publication, when toner images are to be formed on a variety of recording media with different glossiness levels, evenness of glossiness can be improved stably with optimum glossiness levels without reducing graininess.

If the difference between the glossiness (smoothness) of a recording medium itself and the glossiness of an image fixed on the recording medium is large, the quality as a recording medium is reduced to make the user of the recording medium feel a feeling of strangeness for the recording medium. It is desired that the difference between the glossiness of a recording medium itself and the glossiness of an image fixed on the recording medium should fall within a permissible range.

SUMMARY OF THE INVENTION

According to the present invention, an image forming apparatus that forms an image on a recording medium includes a fixing device for heating and pressing a toner image transferred on the recording medium, and a glossiness control device arranged downstream of the fixing device in a conveyance direction of the recording medium. The glossiness control device includes a non-contact heating device arranged downstream of the fixing device in the conveyance direction for heating the toner image without coming into contact with the toner image, and a pressure contact device arranged downstream of the non-contact heating device in the conveyance direction and having a smooth surface. The pressure contact device has a first arrangement state and a second arrangement state which are switched according to a kind of the recording medium. When the pressure contact device forms the first arrangement state, the pressure contact device is arranged such that the surface makes pressure contact with the toner image. When the pressure contact device forms the second arrangement state, the pressure contact device is arranged such that the surface does not make pressure contact with the toner image.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Definition of Terms

Figure 1:
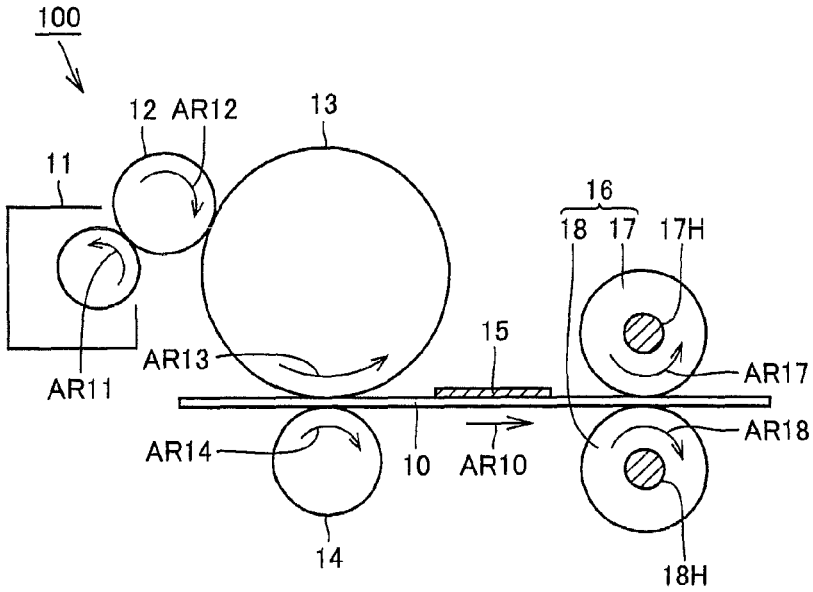
FIG. 1 is a diagram schematically showing an image forming apparatus in a comparative example.

The "glossiness" in the present invention is represented by a value measured with a gloss meter "GMX-203" (MURAKAMI COLOR RESEARCH LABORATORY) at an incident angle 75° according to "JIS-Z8741-1983 method 2."

The "ten-point average roughness Rz" in the present invention refers to a value based on the provision of JIS B0601. Specifically, the "ten-point average roughness Rz" can be obtained by extracting a reference length from a roughness curve and obtaining the sum of a mean value of absolute values of heights of the highest peak to the fifth highest peak and a mean value of absolute values of heights of the lowest peak to the fifth lowest peak with respect to the average line of the extracted portion.

Comparative Example

Prior to a description of embodiments based on the present invention, a comparative example in relation to the present invention will be described below. In the description of the comparative example, the same parts and corresponding parts are denoted with the same reference numerals, and an overlapping description is not always repeated.

(Image Forming Apparatus 100)

FIG. 1 is a diagram schematically showing an image forming apparatus 100 in a comparative example. Image forming apparatus 100 forms an image on a surface of a recording medium 10 using a wet-type electrophotographic technique. The image forming apparatus 100 includes a developing unit 11 rotating in a direction of an arrow AR11, a photoconductor 12 rotating in a direction of an arrow AR12, an intermediate transfer body 13 rotating in a direction of an arrow AR13, a backup member 14 rotating in a direction of an arrow AR14, and a fixing device 16.

Developing unit 11 containing liquid developer forms a toner image on a surface of photoconductor 12. This toner image includes toner particles and carrier liquid. The toner image on photoconductor 12 is transferred onto a surface of recording medium 10 through intermediate transfer body 13. Recording medium 10 having a toner image 15 (toner layer) transferred on its surface is conveyed toward fixing device 16 (see an arrow AR10).

(Fixing Device 16)

Fixing device 16 fixes toner image 15, transferred on the surface of recording medium 10, on the surface of recording medium 10. Fixing device 16 includes a fixing roller 17 and a pressing roller 18 which are arranged to face each other.

Fixing roller 17 and pressing roller 18 each have opposite ends rotatably supported by a bearing member (not shown). Pressing roller 18 is biased (brought into pressure contact) against fixing roller 17 by a pressing mechanism (not shown) having a spring and the like. A fixing nip section is formed between fixing roller 17 and pressing roller 18.

Pressing roller 18 is driven to rotate at a prescribed peripheral speed in a direction of an arrow AR18 by a drive mechanism (not shown). Fixing roller 17 receives pressure-contact friction force from pressing roller 18 through the fixing nip section. The fixing roller 17 receives this pressure-contact friction force and follows to rotate in a direction of an arrow AR17. Fixing roller 17 may be driven to rotate, and pressing roller 18 may follow to rotate.

Fixing roller 17 contains a heater lamp 17H (halogen lamp). The surface temperature of fixing roller 17 is set at a prescribed temperature by a control unit (not shown) controlling heater lamp 17H. Pressing roller 18 also contains a heater lamp 18H (halogen lamp). The surface temperature of pressing roller 18 is set at a prescribed temperature by a control unit (not shown) controlling heater lamp 18H.

Recording medium 10 passes through the fixing nip section formed between fixing roller 17 and pressing roller 18 after toner image 15 is transferred onto the surface thereof. Toner image 15 on recording medium 10 is heated and pressed by fixing roller 17 and pressing roller 18 and fixed at a prescribed fixing strength on the surface of recording medium 10. Image forming apparatus 100 in the comparative example forms an image on the surface of recording medium 10 as described above.

As mentioned at the beginning, if the difference between the glossiness (smoothness) of recording medium 10 itself and the glossiness of an image fixed on recording medium 10 is large, the quality as recording medium 10 is degraded to make the user of recording medium 10 feel a feeling of strangeness. It is desired that the difference between the glossiness of recording medium 10 itself and the glossiness of an image fixed on recording medium 10 should fall within a prescribed permissible range.

General coated paper is high-gloss recording paper with a glossiness of 50 or higher, and the glossiness thereof is, for example, about 70. General high quality paper is low-gloss recording paper with a glossiness of 10 or lower, and the glossiness thereof is, for example, about 5. In order to prevent the user from feeling a feeling of strangeness as described above, it is desired that the difference between the glossiness (smoothness) of recording medium 10 itself and the glossiness of an image fixed on recording medium 10 should be kept to, for example, 10 or lower.

In order to keep the difference to 10 or lower, in the case of coated paper, the value of glossiness of an image fixed on the surface of coated paper should be approximately 60 to 80. On the other hand, in the case of high quality paper (recording paper having low glossiness), the value of glossiness of an image fixed on the surface of high quality paper should be approximately 15 or lower.

In image forming apparatus 100 in the comparative example, when toner image 15 is transferred onto recording medium 10, toner (toner particles) as well as carrier liquid is transferred onto recording medium 10. At the fixing nip section of fixing device 16, recording medium 10, toner, and carrier liquid are heated and pressed.

The toner in toner image 15 transferred on recording medium 10 is fused as a result of this heating and pressing. The carrier liquid in toner image 15 transferred on recording medium 10 is deposited on the surface of toner image 15 as a result of this heating and pressing and is thereafter removed by fixing roller 17, evaporates at the exit of the fixing nip section, penetrates into the inside of recording medium 10, or remains in toner image 15.

In image forming apparatus 100, the toner in toner image 15 transferred on recording medium 10 is inhibited from integration due to the presence of carrier liquid or inhibited from achieving surface smoothness due to the presence of carrier liquid.

Assume that coated paper (recording paper having high glossiness) is used as recording medium 10. In this case, in order to ensure high glossiness of toner image 15 transferred on recording medium 10 in the presence of carrier liquid, it is necessary to reduce the amount of carrier liquid in toner image 15.

As described above, image forming apparatus 100 in the comparative example includes a single fixing device 16 for heating and pressing toner image 15 on recording medium 10. It is difficult to heat and press toner image 15 in a state in which the carrier liquid is reduced because image forming apparatus 100 uses a single fixing device 16 to fix toner image 15. With image forming apparatus 100, it is difficult to ensure a desired high glossiness in coated paper, in terms of compatibility between ensuring glossiness and preventing paper blistering, or in terms of ensuring a nip time in a high-speed device.

Assume that image forming apparatus 100 in the comparative example includes a plurality of fixing devices 16. When thick paper is used as recording medium 10 that is coated paper, the temperature of recording medium 10 (toner and carrier liquid) is less increased. Many fixing devices 16 are required to appropriately heat and press recording medium 10, leading to a size increase of the apparatus and an increase in manufacturing cost. When thin paper is used as recording medium 10 that is coated paper, paper wrinkling easily occurs in recording medium 10 when recording medium 10 passes through a plurality of fixing devices 16.

On the other hand, assume that high quality paper (recording paper having low glossiness) is used as recording medium 10. In this case, it is necessary to fix toner image 15 on recording medium 10 in a state in which the concealment of toner image 15 is ensured (in other words, the surface irregularity of high quality paper is covered with toner image 15). However, in the state in which the concealment of toner image 15 is ensured, when toner image 15 is fused at the fixing nip section with a prescribed fixing strength being kept, the surface of toner image 15 is smoothed below a desired level, and the glossiness of the fixed image becomes too higher than the glossiness of the high quality paper itself.

Therefore, in the image forming using image forming apparatus 100 in the comparative example, it is difficult to keep the glossiness of recording medium 10 itself and the glossiness of an image fixed on recording medium 10 within a desired permissible range. As a result, the user of recording medium 10 having an image formed thereon using image forming apparatus 100 feels a feeling of strangeness.

Embodiments

Embodiments based on the present invention will be described below with reference to the figures. The scope of the invention is not necessarily limited to the number, quantity, etc. mentioned in the description of the embodiments, unless otherwise specified. In the description of the embodiments, the same parts and corresponding parts are denoted with the same reference numerals, and an overlapping description is not always repeated.

First Embodiment (Image Forming Apparatus 200)

Figure 2:
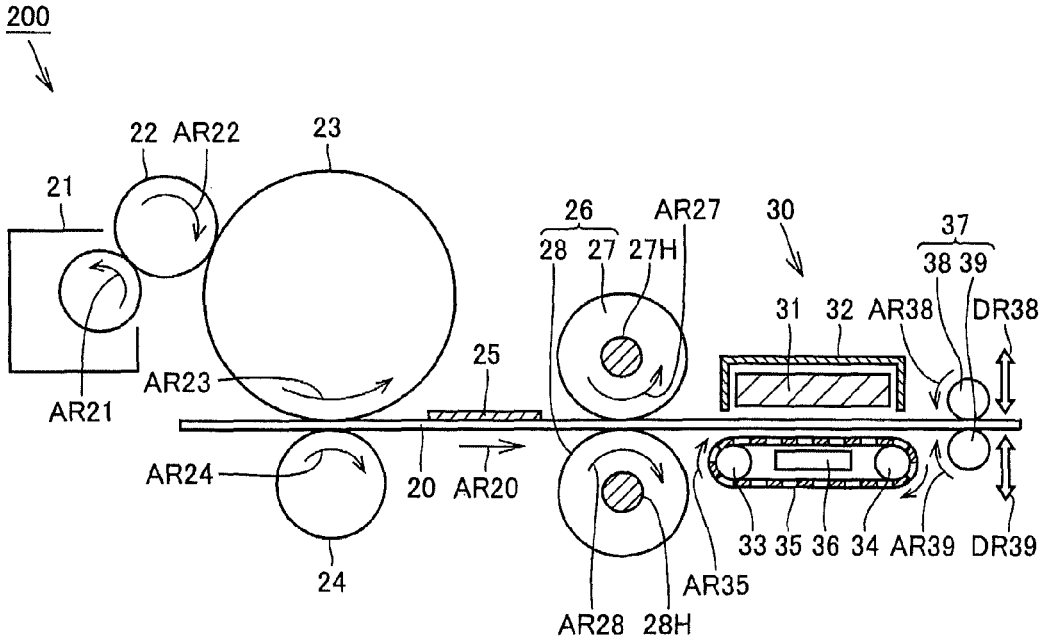
FIG. 2 is a diagram schematically showing an image forming apparatus in a first embodiment.

FIG. 2 is a diagram schematically showing an image forming apparatus 200 in the present embodiment. Image forming apparatus 200 forms an image on a surface of a recording medium 20 using a wet-type electrophotographic technique. Image forming apparatus 200 includes a developing unit 21 rotating in a direction of an arrow AR21, a photoconductor 22 rotating in a direction of an arrow AR22, an intermediate transfer body 23 rotating in a direction of an arrow AR23, a backup member 24 rotating in a direction of an arrow AR24, a fixing device 26, and a glossiness control device 30.

Developing unit 21 containing liquid developer forms a toner image on a surface of photoconductor 22. This toner image includes toner particles and carrier liquid. The toner image on photoconductor 22 is transferred onto the surface of recording medium 20 through intermediate transfer body 23. Recording medium 20 having a toner image 25 (toner layer) transferred on its surface is conveyed toward fixing device 26 (see an arrow AR20).

(Liquid Developer)

An insulating solvent is used as a carrier liquid used in the liquid developer. Toner particles used in the liquid developer are mainly composed of resin and pigment or dye for coloring. The resin has a function of evenly distributing the pigment or dye into the resin and a function as a binder when a toner image is fixed on a print medium.

The volume average particle size of toner particles in the liquid developer is preferably not less than 0.1 μm and not more than 5 μm. The volume average particle size of not less than 0.1 μm of toner particles in the liquid developer is favorable in terms of easiness of development. The volume average particle size of not more than 5 μm of toner particles in the liquid developer is favorable in terms of quality improvement of an image.

The mass proportion of toner particles to liquid developer is preferably not less than 10% and not more than 50%. The mass proportion of toner particles to liquid developer of not less than 10% is favorable in that precipitation of toner particles are less likely to occur and in terms of stability over time during long-time storage. The amount of developer required to obtain a desired image density can be reduced.

The mass proportion of toner particles to liquid developer of not more than 50% is favorable in terms of production and handleability because the viscosity of liquid developer is not too high. In the present embodiment, the volume average particle size is 2 μm, and the mass proportion of toner particles to liquid developer is 30%.

(Fixing Device 26)

Fixing device 26 fixes toner image 25, transferred on the surface of recording medium 20, on the surface of recording medium 20. Fixing device 26 in the present embodiment is of a roller type and includes a fixing roller 27 and a pressing roller 28 which are arranged to face each other. Fixing device 26 may be of a belt type.

Fixing roller 27 and pressing roller 28 each have opposite ends rotatably supported by a bearing member (not shown). Pressing roller 28 is biased (brought into pressure contact) against fixing roller 27 by a pressing mechanism (not shown) having a cam or a spring. A pressure-contact nip section is formed between fixing roller 27 and pressing roller 28.

Pressing roller 28 is driven to rotate at a prescribed peripheral speed in a direction of an arrow AR28 by a drive mechanism (not shown). Fixing roller 27 receives pressure-contact friction force from pressing roller 28 through the pressure-contact nip section. Fixing roller 27 receives this pressure-contact friction force and follows to rotate in a direction of an arrow AR27. Fixing roller 27 may be driven to rotate, and pressing roller 28 may follow to rotate.

Fixing roller 27 contains a heater lamp 27H (halogen lamp). The surface temperature of fixing roller 27 is set at a prescribed temperature by a control unit (not shown) controlling heater lamp 27H. Pressing roller 28 also contains a heater lamp 28H (halogen lamp). The surface temperature of pressing roller 28 is set at a prescribed temperature by a control unit (not shown) controlling heater lamp 28H.

Fixing roller 27 and pressing roller 28 each are formed with a hollow metal core (thickness of 0.5 mm to 5 mm) with high heat conductivity, made of aluminum or the like, an elastic layer (thickness of 0.5 mm to 3 mm) provided on the outer periphery of the metal core for ensuring a nip width, and a release layer (thickness of 10 μm to 50 μm) provided on the outer periphery of the elastic layer for enhancing releasability of the surface. For example, silicone rubber is used for the elastic layer. For example, fluoropolymer such as PTFE (polytetrafluoroethylene) or PFA (perfluoroalkoxy polymer) is used for the release layer.

Recording medium 20 passes through the pressure contact nip section formed between fixing roller 27 and pressing roller 28 after toner image 25 is transferred on the surface thereof. Toner image 25 on recording medium 20 is heated and pressed by fixing roller 27 and pressing roller 28 and fixed on the surface of recording medium 20 at a prescribed fixing strength. After passing through fixing device 26, recording medium 20 is conveyed toward glossiness control device 30 as described next.

(Glossiness Control Device 30)

Glossiness control device 30 is arranged downstream of fixing device 26 in the conveyance direction (the direction of arrow AR20) of recording medium 20. Glossiness control device 30 includes a non-contact heater 31, a heat insulation cover 32, a suction belt 35, and a pressure contact device 37.

(Non-Contact Heater 31/Heat Insulation Cover 32)

Non-contact heater 31 (non-contact heating device) is arranged downstream of fixing device 26 in the conveyance direction of recording medium 20. Non-contact heater 31 can heat the recording surface (the surface on which toner image 25 is fixed) of recording medium 20 and toner image 25 fixed on recording medium 20 without coming into contact with them. Heat insulation cover 32 is provided to cover non-contact heater 31 from the side opposite to the conveyance path of recording medium 20.

The temperature of the heating surface of non-contact heater 31 is set at a desired temperature (for example, 200° C. to 700° C.) by a control unit (not shown). Considering the difference in light absorption between black toner, and yellow, magenta, cyan and a non-image formation portion, the one that radiates long wavelengths (infrared rays), such as a ceramic heater, is preferably used as non-contact heater 31. The one that radiates near infrared rays, such as a flash lamp, or the one capable of blowing hot air may be used as the non-contact heater 31.

Heat insulation cover 32 is provided, if necessary. Heat insulation cover 32 keeps the temperature surrounding non-contact heater 31 at high temperatures and can improve the heating efficiency of non-contact heater 31. The material of heat insulation cover 32 preferably has high heat insulation performance and high heat resistance, and, for example, ceramic fibers are used.

An air flow unit (not shown), configured with a fan, a duct, and the like, may be provided at the periphery of non-contact heater 31. Carrier liquid (vapor) that evaporates from toner image 25 between non-contact heater 31 and recording medium 20 is exhausted by the air flow unit to the outside from the periphery of non-contact heater 31. Even when the amount of volatilized carrier liquid increases, the saturation vapor pressure of carrier liquid in the periphery of non-contact heater 31 can be effectively reduced. Although non-contact heater 31 in the present embodiment is configured so as to heat recording medium 20 from the recording surface side on which toner image 25 is fixed, non-contact heater 31 may be configured so as to heat recording medium 20 from the opposite surface side.

(Suction Belt 35)

Suction belt 35 is formed in an annular shape from a heat-resistant material such as silicone rubber. Suction belt 35 is provided vertically below non-contact heater 31, and the surface of suction belt 35 is arranged to extend along the conveyance path of recording medium 20. Suction belt 35 has a plurality of suction holes 35T (see FIG. 3) for sucking recording medium 20 conveyed by suction belt 35.

Suction belt 35 is wound around a driving roller 33 and a driven roller 34. Driving roller 33 and driven roller 34 each are formed of a roller made of a metal such as aluminum. Driving roller 33 is driven to rotate by a drive mechanism (not shown). With the rotation of driving roller 33, suction belt 35 rotates in a direction of an arrow AR35. Driven roller 34 follows the rotation through suction belt 35.

The rotational speed of driving roller 33 is controlled such that the surface of suction belt 35 moves at a desired speed. The positional relation between driving roller 33 and driven roller 34 in the conveyance direction of recording medium 20 may be in such a manner as shown in FIG. 2 or may be opposite to the manner shown in FIG. 2.

Figure 3:
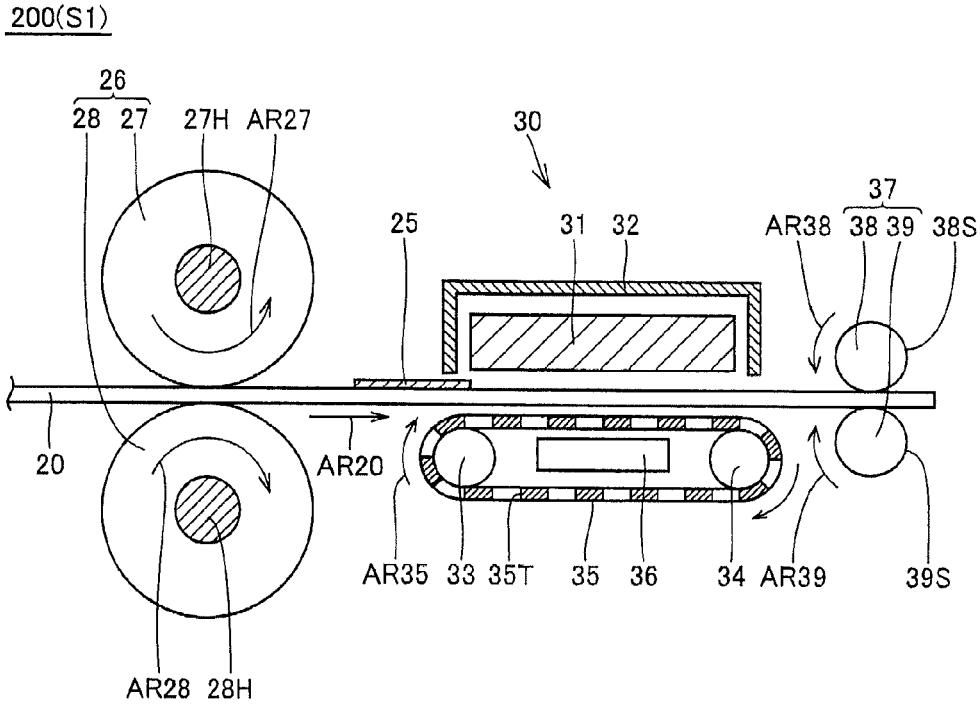
FIG. 3 is a diagram schematically showing a fixing device and a glossiness control device (a first arrangement state) of the image forming apparatus in the first embodiment.

A suction fan 36 is provided in the inside of suction belt 35. Suction fan 36 sucks recording medium 20, conveyed by suction belt 35, through a plurality of suction holes 35T (FIG. 3). When suction belt 35 conveys recording medium 20 below non-contact heater 31, recording medium 20 is sucked through a plurality of suction holes 35T and is adsorbed on the surface of suction belt 35.

(Pressure Contact Device 37)

Pressure contact device 37 is arranged downstream of non-contact heater 31 in the conveyance direction of recording medium 20. Although detailed later, pressure contact device 37 has a first arrangement state S1 (see FIG. 3) and a second arrangement state S2 (see FIG. 4) which are switched according to the kind of recording medium 20 (the glossiness, paper weight in gsm, thickness, etc. of recording medium 20).

Pressure contact device 37 in the present embodiment includes a pressing roller 38 and a backup roller 39 which are arranged to face each other. Pressing roller 38 has a smooth surface 38S (see FIG. 3). Backup roller 39 has a smooth surface 39S (see FIG. 3). The values of ten-point average roughness Rz of surfaces 38S and 39S are preferably not more than 2 μm.

Pressing roller 38 has opposite ends rotatably supported by a bearing member (not shown). Pressing roller 38 is driven to rotate at a prescribed peripheral speed in a direction of an arrow AR38 by a drive mechanism (not shown). Pressing roller 38 is configured to be able to be reciprocated in the direction of arrow AR38 by a displacement mechanism (not shown) having a cam or a spring.

Backup roller 39 has opposite ends rotatably supported by a bearing member (not shown). Backup roller 39 is also configured to be able to be reciprocated in the direction of arrow AR39 by a displacement mechanism (not shown) having a cam or a spring.

When the displacement mechanism arranges pressing roller 38 and backup roller 39 in pressure contact with each other, a pressure-contact nip section is formed between pressing roller 38 and backup roller 39. Backup roller 39 receives pressure-contact friction force from pressing roller 38 driven to rotate. Backup roller 39 receives this pressure-contact friction force and follows to rotate in the direction of arrow AR39. Backup roller 39 may be driven to rotate, and pressing roller 38 may follow to rotate.

When pressing roller 38 and backup roller 39 are arranged to be close to each other (first arrangement state S1), each of surfaces 38S and 39S makes pressure contact with toner image 25 on recording medium 20 at a prescribed pressure (see FIG. 3). On the other hand, when pressing roller 38 and backup roller 39 are arranged to be separated from each other (second arrangement state S2), each of surfaces 38S and 39S does not make pressure contact with toner image 25 on recording medium 20 (see FIG. 4). In second arrangement state S2, the displacement mechanism may arrange pressing roller 38 and backup roller 39 so as to be completely separated from recording medium 20.

Pressing roller 38 is formed with a core made of a metal such as SUS and a surface layer member (thickness of 10 μm to 50 μm) provided on the outer periphery of the metal core for ensuring high smoothness and good releasability of surface 38S. Fluoropolymer such as PTFE or PFA is preferably used as the surface layer member.

For example, a metal roller, for example, made of SUS is used as backup roller 39. In order to apply more uniform pressure to recording medium 20, backup roller 39 may be formed of a metal core, for example, made of SUS and an elastic layer provided on the outer periphery of the metal core. In this case, for example, hard silicone robber (thickness of 0.1 mm to 1 mm) is preferably used as the elastic layer. In order to ensure good releasability during duplex printing, fluoropolymer (thickness of 10 μm to 50 μm) such as PTFE or PFA may be used as a material of surface 39S of backup roller 39. In order to ensure sufficient pressure on recording medium 20, it is preferable that the rubber hardness of the elastic layer used for backup roller 39 should be high.

In the present embodiment, both of pressing roller 38 and backup roller 39 are configured to be able to be reciprocated by the displacement mechanism. By contrast, only pressing roller 38 may be configured to be able to reciprocated by the displacement mechanism. In this case, backup roller 39 is always arranged along the conveyance path of recording medium 20 and is driven to rotate in the direction of arrow AR39 by a drive mechanism (not shown). Image forming apparatus 200 in the present embodiment is configured as described above.

(Operation and Effects of Image Forming Apparatus 200)

Recording medium 20 having toner image 25 (toner layer) transferred on its surface is conveyed toward fixing device 26 as described above (see arrow AR20). Toner image 25 on recording medium 20 passing through the fixing nip section between fixing roller 27 and pressing roller 28 is thus fixed at a prescribed fixing strength on the surface of recording medium 20.

Here, as in image forming apparatus 100 in the comparative example, toner image 25 on recording medium 20 arriving at fixing device 26 includes toner and carrier liquid. Recording medium 20, toner, and carrier liquid are heated and pressed at the fixing nip section of fixing device 26.

The toner in toner image 25 transferred on recording medium 20 is fused as a result of this heating and pressing. As a result of this heating and pressing, the carrier liquid in toner image 25 transferred on recording medium 20 is deposited on the surface of toner image 25 and is thereafter removed by fixing roller 27, evaporates at the exit of the fixing nip section, penetrates into the inside of recording medium 20, or remains in toner image 25.

It is assumed that coated paper (recording paper having high glossiness) is used as recording medium 20. In this case, at the time when toner image 25 on recording medium 20 passes through the fixing nip section, much carrier liquid remains in toner image 25. The temperature of toner image 25 is less increased before and after the fixing nip section. Even after recording medium 20 passes through the fixing nip section, the amount of carrier liquid is not reduced enough to such a level that can ensure a desired glossiness for coated paper.

Suppose that recording medium 20 is discharged to the outside with this state being kept. In this case, the smoothness of the image finally formed on recording medium 20 from toner image 25 is degraded due to the history of carrier liquid existing on the surface of toner image 25 (the interface between toner image 25 and fixing roller 27) and/or the history of carrier liquid deposited on the surface of toner image 25 from toner image 25 at the fixing nip section. As a result, the glossiness of the image is not enough.

As a result, the difference between the glossiness (smoothness) of recording medium 20 itself and the glossiness of the image finally formed on recording medium 20 is increased. In the case where thick paper is used as recording medium 20 that is coated paper, the temperature of recording medium 20 and the temperature of toner image 25 are even less increased. Thus, this difference is increased more. Therefore, it is necessary to effectively reduce the amount of carrier liquid in toner image 25 in order to ensure high glossiness of toner image 25 transferred on recording medium 20 in the presence of carrier liquid.

On the other hand, it is assumed that high quality paper (recording paper having low glossiness) is used as recording medium 20. In this case, it is necessary to fix toner image 25 on recording medium 20 in a state in which the concealment of toner image 25 is ensured (in other words, the surface irregularity of high quality paper is covered with toner image 25). However, in the state in which the concealment of toner image 25 is ensured, when toner image 25 is fused at the fixing nip section with a prescribed fixing strength being kept, the surface of toner image 25 is smoothed to a level below a desired level.

Suppose that recording medium 20 is discharged to the outside with this state being kept. In this case, the glossiness of the fixed image becomes too higher than the glossiness of the high quality paper itself. As a result, the difference between the glossiness (smoothness) of recording medium 20 itself and the glossiness of the image finally formed on recording medium 20 is increased.

In short, in the case where coated paper is used as recording medium 20, toner image 25 on recording medium 20 passing through fixing device 26 does not have sufficient glossiness, whereas in the case where high quality paper (recording paper having low glossiness) is used as recording medium 20, toner image 25 on recording medium 20 passing through fixing device 26 has glossiness higher than necessary.

As described above, in image forming apparatus 200 in the present embodiment, glossiness control device 30 is provided downstream of fixing device 26 in the conveyance direction of recording medium 20 (the direction of arrow AR20). Glossiness control device 30 operates so that the difference between the glossiness (smoothness) of recording medium 20 itself and the glossiness of the image finally formed on recording medium 20 can be kept within a desired permissible range. The operation and effects of glossiness control device 30 will be specifically described below.

(Coated Paper: Recording Paper Having High Glossiness)

Referring to FIG. 3, the case where coated paper is used as recording medium 20 is described. In this case, pressure contact device 37 of glossiness control device 30 is controlled to form first arrangement state S1. In first arrangement state S1, pressing roller 38 and backup roller 39 are arranged to come closer to each other, and their respective surfaces 38S and 39S make pressure contact with toner image 25 on recording medium 20 at a prescribed pressure.

As described above, toner image 25 on recording medium 20 passing through fixing device 26 does not have sufficient glossiness for recording medium 20 as coated paper. In this state, recording medium 20 is conveyed by suction belt 35 in the direction of arrow AR20 and is heated by non-contact heater 31.

Non-contact heater 31 heats toner image 25 (toner and carrier liquid) on recording medium 20 and recording medium 20 mainly by the effect of radiation. The toner in toner image 25 is fused (re-fused), and the carrier liquid in toner image 25 evaporates mostly. In this state, recording medium 20 is further conveyed in the direction of arrow AR20 and reaches the pressure contact nip section of pressure contact device 37.

At the pressure contact nip section, pressing roller 38 and backup roller 39 are arranged to make pressure contact with each other. The fused (softened) toner image 25 on recording medium 20 is brought into pressure contact at a prescribed pressure by pressing roller 38. Pressing roller 38 and backup roller 39 do not have to heat toner image 25 on recording medium 20 at the pressure contact nip section because toner image 25 on recording medium 20 has already been heated by non-contact heater 31.

Pressing roller 38 and backup roller 39 do not have to have a nip width as wide as the fixing nip section at fixing device 26, and their respective surfaces 38S and 39S do not have to be formed of elastic layers. In a general fixing device, because of a wide nip width at the fixing nip section, it is more likely that the roller elastic layer expands/contracts in the axial direction to cause paper wrinkling. By contrast, paper wrinkling hardly occurs in recording medium 20 when passing through pressure contact device 37 because surfaces 38S and 39S are not formed of elastic layers. From a viewpoint of applying more uniform pressure to recording medium 20, only backup roller 39 may be provided with a thin and hard elastic layer.

The fused (softened) toner image 25 on recording medium 20 is brought into pressure contact at a prescribed pressure at the pressure contact nip section, so that the surface of toner image 25 is smoothed. Toner image 25 on recording medium 20 passing through pressure contact device 37 has a desired glossiness for recording medium 20 as coated paper.

Therefore, with image forming apparatus 200, even in the case where coated paper is used as recording medium 20, the difference between the glossiness of recording medium 20 itself and the glossiness of the image formed on recording medium 20 can be reduced and can be kept within a desired permissible range.

(High Quality Paper: Recording Paper Having Low Glossiness)

Figure 4:
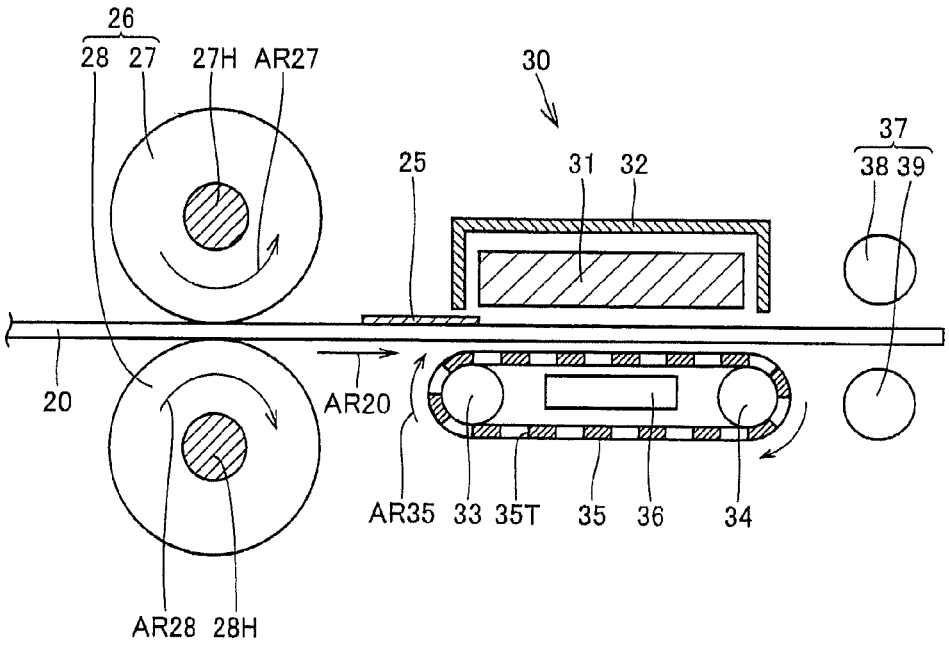
FIG. 4 is a diagram schematically showing the fixing device and the glossiness control device (a second arrangement state) of the image forming apparatus in the first embodiment.

Referring to FIG. 4, the case where high quality paper is used as recording medium 20. In this case, pressure contact device 37 of glossiness control device 30 is controlled to form second arrangement state S2. In second arrangement state S2, pressing roller 38 and backup roller 39 are arranged to be separated from each other, and their respective surfaces 38S and 39S do not make pressure contact with toner image 25 on recording medium 20.

As described above, backup roller 39 may not be completely separated from recording medium 20. In this case, backup roller 39 is preferably driven to rotate such that the conveyance speeds of its surface 39S and recording medium 20 are equal to each other.

Toner image 25 on recording medium 20 passing through fixing device 26 has glossiness higher than necessary for recording medium 20 as high quality paper. In this state, recording medium 20 is conveyed in the direction of arrow AR20 by suction belt 35 and is heated by non-contact heater 31.

Non-contact heater 31 heats toner image 25 (toner and carrier liquid) on recording medium 20 and recording medium 20 mainly by the effect of radiation. The toner in toner image 25 is fused (re-fused), and the carrier liquid in toner image 25 evaporates mostly. The shape of the fused toner is elastically restored, and the granularity of toner is reproduced.

By promoting the fusion of toner, toner penetrates between fibers of recording medium 20 (high quality paper) and moves to conform to irregular shapes formed on the surface of high quality paper. Here, toner image 25 is heated in a non-contact state (in an open system) by non-contact heater 31. Therefore, there is no concern about high-temperature offset. The surface of toner image 25 has irregular shapes, so that toner image 25 on recording medium 20 has a desired glossiness for recording medium 20 as high quality paper.

Therefore, with image forming apparatus 200, even in the case where high quality paper is used as recording medium 20, the difference between the glossiness of recording medium 20 itself and the glossiness of the image formed on recording medium 20 can be reduced and can be kept within a desired permissible range. In image forming apparatus 200, the carrier liquid penetrating in recording medium 20 by the effect of heating by non-contact heater 31 evaporates, thereby preventing a strike-through phenomenon.

In image forming apparatus 200, first arrangement state S1 (see FIG. 3) and second arrangement state S2 (see FIG. 4) of glossiness control device 30 (pressure contact device 37) are switched according to the kind of recording medium 20 (the glossiness, paper weight in gsm, thickness, etc. of recording medium 20). Glossiness control device 30 may be configured such that the heating conditions (for example, heating method, heating temperature, or heating time) of non-contact heater 31 for recording medium 20 may be optimally controlled according to the kind of recording medium 20 or a glossiness mode (for example, a more glossy, high-glossiness image quality mode) of coated paper. The kind of recording medium 20 may be detected automatically with a detector provided in image forming apparatus 200. The arrangement states of glossiness control device 30 may be switched by the user's mode setting on the operation panel of image forming apparatus 200.

In the case where coated paper is used as recording medium 20, pressure contact device 37 may be configured such that the pressure contact conditions (pressure-contact force, the width of the pressure contact nip section, or pressure contact time) for recording medium 20 by pressing roller 38 and backup roller 39 are optimally controlled according to the kind of recording medium 20 or a glossiness mode (for example, a more glossy, high-glossiness image quality mode). With such configurations, image forming apparatus 200 can flexibly adapt to various paper and image modes and can even further reduce the difference between the glossiness of recording medium 20 itself and the glossiness of the image formed on recording medium 20.

Experimental Examples

Figure 5:
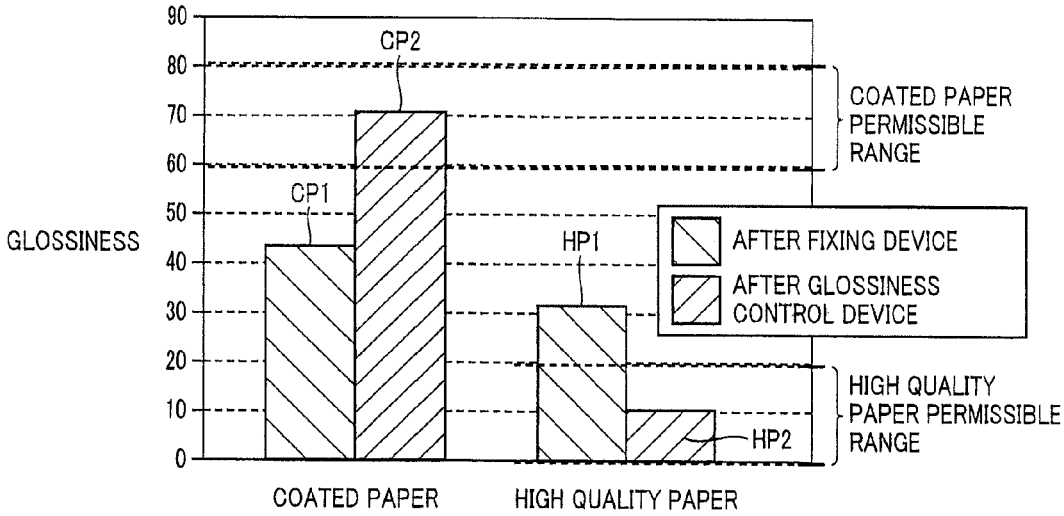
FIG. 5 is a graph showing results of experimental examples concerning the first embodiment.

Referring to FIG. 5, experiments were conducted using image forming apparatus 200 based on the first embodiment. When coated paper was used as recording medium 20, the value of glossiness CP1 of the image on recording medium 20 was about 44 after passing through fixing device 26. The value of glossiness CP2 of the image on recording medium 20 was about 72 after passing through glossiness control device 30.

The image on recording medium 20 after passing through glossiness control device 30 has a desired glossiness (within a permissible range) required for recording medium 20 as coated paper. As is understood from this result, with image forming apparatus 200 in the present embodiment, the difference between the glossiness of recording medium 20 itself and the glossiness of the image formed on recording medium 20 can be kept within a desired permissible range.

On the other hand, when high quality paper (recording paper having low glossiness) was used as recording medium 20, the value of glossiness HP1 of the image on recording medium 20 was about 32 after passing through fixing device 26. The value of glossiness HP2 of the image on recording medium 20 was about 10 after passing through glossiness control device 30.

The image on recording medium 20 after passing through glossiness control device 30 has a desired glossiness (within a permissible range) required for recording medium 20 as high quality paper (recording paper having low glossiness). As is understood from this result, with image forming apparatus 200 in the present embodiment, the difference between the glossiness of recording medium 20 itself and the glossiness of the image formed on recording medium 20 can be kept within a desired permissible range.

Second Embodiment

Figure 6:
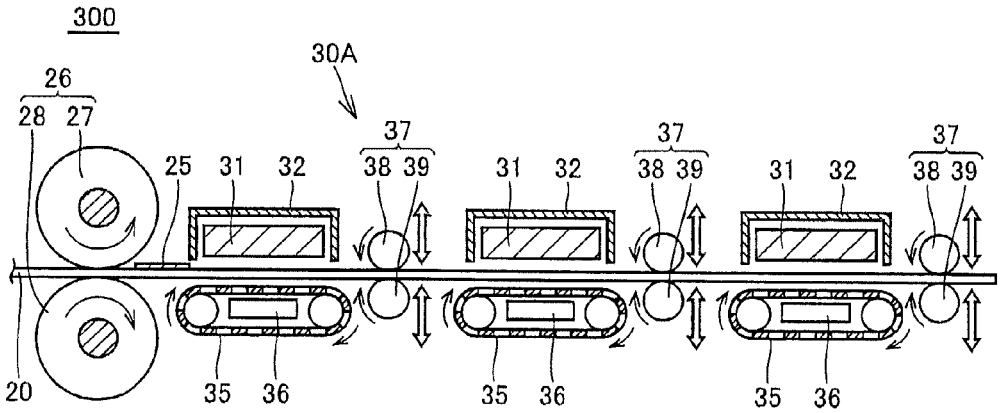
FIG. 6 is a diagram schematically showing an image forming apparatus in a second embodiment.

Referring to FIG. 6, an image forming apparatus 300 in the present embodiment will now be described. A glossiness control device 30A in image forming apparatus 300 includes a plurality of non-contact heaters 31 and a plurality of pressure contact devices 37. In image forming apparatus 300, three units each including a combination of non-contact heater 31 and pressure contact device 37 are provided side by side.

The heating conditions (for example, heating method, heating temperature, ON/OFF of heating, or heating time) of each non-contact heater 31 for recording medium 20 are optimally controlled according to the kind of recording medium 20 or a glossiness mode for coated paper (for example, a more glossy, high-glossiness image quality mode). In the case where coated paper is used as recording medium 20, the pressure contact conditions (for example, pressure contact force, the width of the pressure contact nip section, or pressure time) for recording paper 20 by each pressing roller 38 and backup roller 39 are optimally controlled according to the kind of recording medium 20 or a glossiness mode for coated paper (for example, a more glossy, high-glossiness image quality mode).

Image forming apparatus 300 can enlarge the controllable parameter range of heating conditions and pressure contact conditions and can more flexibly adapt to various paper and image modes, so that the difference between the glossiness of recording medium 20 itself and the glossiness of the image formed on recording medium 20 can be even further reduced.

Third Embodiment

Figure 7:
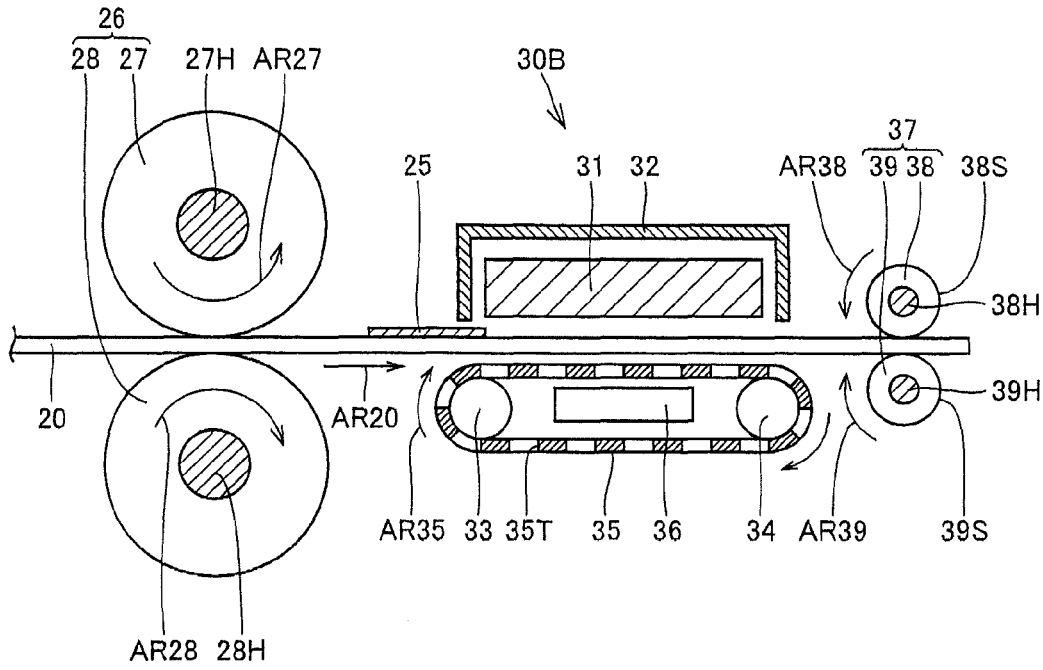
FIG. 7 is a diagram schematically showing an image forming apparatus in a third embodiment.

Referring to FIG. 7, an image forming apparatus 400 according to the present embodiment will be described. In a glossiness control device 30B in image forming apparatus 400, pressing roller 38 contains a heater lamp 38H (halogen lamp), and backup roller 39 contains a heater lamp 39H (halogen lamp). The temperature of surface 38S of pressing roller 38 is set at a prescribed temperature by a control unit (not shown) controlling heater lamp 38H. The temperature of surface 39S of backup roller 39 is also set at a prescribed temperature by a control unit (not shown) controlling heater lamp 39H.

Heater lamps 38H and 39H as heating sources are controlled appropriately, so that the temperatures of the respective surfaces 38S and 39S of pressing roller 38 and backup roller 39 can be adjusted at stable values. In the case where coated paper is used as recording medium 20, the image on recording medium 20 is heated at stable temperatures, so that the glossiness of the image on recording medium 20 can be controlled more finely. Heater lamps 38H and 39H may not necessarily be configured so as to heat the image on recording medium 20. The temperature of surface 38S of pressing roller 38 may not necessarily be set higher than the temperature of the image on recording medium 20 heated by non-contact heater 31.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming apparatus that forms an image on a recording medium, comprising:

a fixing device for heating and pressing a toner image transferred on said recording medium; and a glossiness control device arranged downstream of said fixing device in a conveyance direction of said recording medium;

said glossiness control device including a plurality of non-contact heating devices arranged downstream of said fixing device in said conveyance direction for heating said toner image without coming into contact with said toner image, and a plurality of pressure contact devices arranged downstream of said non-contact heating device in said conveyance direction and having a smooth surface, wherein each said pressure contact device has a first arrangement state and a second arrangement state which are switched according to a kind of said recording medium, when each said pressure contact device forms said first arrangement state, said pressure contact device is arranged such that said surface makes pressure contact with said toner image, and when each said pressure contact device forms said second arrangement state, said pressure contact device is arranged such that said surface does not make pressure contact with said toner image, and wherein heating conditions of a plurality of said non-contact heating devices for said toner image and pressure contact conditions of a plurality of said pressure contact devices for said toner image are controlled according to a kind of said recording medium or glossiness of said recording medium.

2. The image forming apparatus according to claim 1, wherein said pressure contact device forms said first arrangement state when said image forming apparatus forms said image on said recording medium having high glossiness, and forms said second arrangement state when said image forming apparatus forms said image on said recording medium having low glossiness.

3. The image forming apparatus according to claim 1, wherein a ten-point average roughness Rz of said surface of said pressure contact device is not more than 2 μm.

4. The image forming apparatus according to claim 1, wherein said pressure contact device has a heating source that can adjust a temperature of said surface.

* * * * *